US009190039B2

(12) United States Patent
Lee et al.

(10) Patent No.: US 9,190,039 B2
(45) Date of Patent: Nov. 17, 2015

(54) RADIATION CURABLE DRUMHEAD MEMBRANE

(71) Applicant: D'Addario & Company, Inc., Farmingdale, NY (US)

(72) Inventors: Steve Lee, Farmingdale, NY (US); Craig Harbauer, Northport, NY (US); Rosa Espinal, Lindenhurst, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 420 days.

(21) Appl. No.: 13/803,932

(22) Filed: Mar. 14, 2013

(65) Prior Publication Data

US 2014/0260894 A1 Sep. 18, 2014

(51) Int. Cl.
*G10D 13/02* (2006.01)

(52) U.S. Cl.
CPC ..... *G10D 13/027* (2013.01)

(58) Field of Classification Search
CPC ... G10D 13/02; G10D 13/021; G10D 13/027; G10D 13/022
USPC ..... 84/411 R
See application file for complete search history.

(56) References Cited

U.S. PATENT DOCUMENTS

| | | | | |
|---|---|---|---|---|
| 2,667,098 | A * | 1/1954 | McMullen | 84/414 |
| 6,175,068 | B1 * | 1/2001 | Belli | 84/414 |
| 7,099,067 | B2 * | 8/2006 | Chen | 359/321 |
| 2008/0145624 | A1 * | 6/2008 | Weikard et al. | 428/195.1 |

FOREIGN PATENT DOCUMENTS

| | | | | |
|---|---|---|---|---|
| JP | 407164723 | A * | 6/1995 | B41M 1/12 |

* cited by examiner

*Primary Examiner* — Kimberly Lockett
(74) *Attorney, Agent, or Firm* — Alix, Yale & Ristas, LLP

(57) ABSTRACT

A drumhead and a method for coating a drumhead membrane comprising applying a coating having cross linkable polymeric material to the membrane and applying energy to cross link the polymeric material and thereby permanently adhere the material to the membrane as a play surface. The cross-linking not only hardens the coating to improve durability, but also improves the adhesion of the coating to the base film. Actinically cured coatings can completely harden in a matter of 3 to 5 seconds, with UV cured inks being especially desirable.

19 Claims, 1 Drawing Sheet

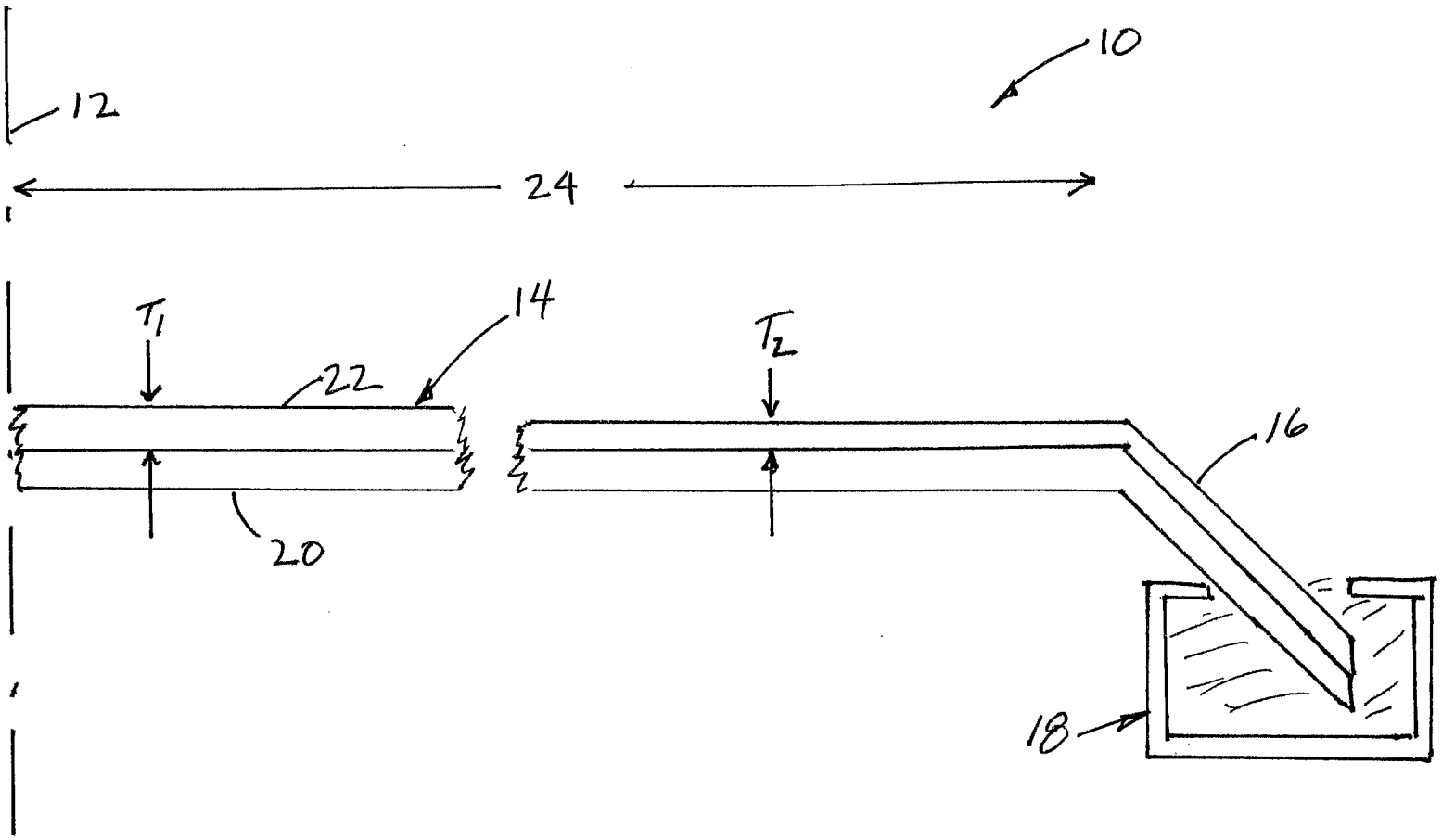
10
12
14
16
18
20
22
24
$T_1$
$T_2$

RADIATION CURABLE DRUMHEAD MEMBRANE

BACKGROUND

The present invention relates to drumheads and in particular to the membrane and associated play surface of the drumhead.

Conventionally, drumheads are manufactured by processing a plastic film or membrane for desirable acoustic properties when the membrane is tensioned on the bearing edge of a drum shell. Sheets of processed film are cut and shaped with a collar region which is secured into a circular hoop that is engaged by tensioning components on the drum shell. A circular area within the hoop defines a play surface on which the percussionist can produce various sounds with, for example, sticks or brushes.

It is common to coat a plastic film such as Mylar with ink, using a mesh screen, to achieve coloration as well as subtle variations in the acoustic response of the drumhead. Typically, the ink is dried by evaporation in an oven or under a heating lamp. The drying time generally ranges from about 3 hours to 10 minutes. When a large area of coated film or many drumheads in progress are to be dried in one relatively small oven or arrangement of lamps, the drying step becomes a bottleneck in the overall drumhead manufacturing process.

SUMMARY

One object of the present invention is to provide a method for quickly drying a play-surface coating applied to the base film of a drumhead.

Another object is to provide a method for increasing the durability of the coating.

Yet another object is to provide greater flexibility for manufacturing drumheads having different targeted acoustic properties.

According to one aspect, the invention is directed to a method for coating a drumhead membrane comprising applying a coating having cross linkable polymeric material to the membrane and applying energy to cross link the polymeric material and thereby permanently adhere the material to the membrane as a play surface. The cross-linking not only hardens the coating to improve durability, but also improves the adhesion of the coating to the base film. Actinically cured coatings can completely harden in a matter of 3 to 5 seconds, with UV cured inks being especially desirable. Accordingly, the manufacturing throughput can be dramatically increased.

Coatings having a range of dispersed solids offer the flexibility of targeting the roughness of the play surface to achieve a desired acoustic response to brushes drawn across the play surface. Further flexibility is achievable by varying the thickness of the coating, for example, from a central area toward the periphery.

In the preferred embodiment, the coating is a UV curable ink comprising at least one acrylated oligomer, at least one acrylated monomer, at least one glycol ether acrylate, and a photoinitiator. The coating is applied with a 175 mesh screen, for a cured thickness of about 0.00165 inch. The coating has dispersed solids, such as silicon dioxide, to produce a play surface having a roughness of at least about 100 microinches, and preferably in the range of about 135 to 200 microinches.

According to another aspect, the invention is directed to a drumhead comprising a plastic membrane having a play surface comprising a coating of cross linked polymeric material. Preferably, the coating comprises a UV cross linked polymeric composition, especially a composition having at least one acrylated oligomer, at least one acrylated monomer, at least one glycol ether acrylate, and dispersed solids providing a roughness on the play surface of at least about 120 microinches, most preferably in the range of about 135 to 200 microinches.

BRIEF DESCRIPTION OF THE DRAWING

FIG. 1 is a schematic cross-section of a portion of a coated drumhead film according to the present invention, having a non-uniform thickness from the center toward the periphery of the play surface.

DETAILED DESCRIPTION

FIG. 1 shows a section of a circular drumhead 10 having a center 12 and a generally circular filmic material 14 extending outwardly in a substantially flat manner and in a collar region 16 extending downwardly at the periphery into a hoop 18. The filmic material comprises a plastic, generally Mylar, base film a 20 and a coating 22 adhered to the base film. After mounting of the drumhead 10 on a drum shell (not shown), the circular area 24 inside of collar 16, defines the play area of the drumhead.

The coating 22 is applied to the base film 20 before the filmic material 14 is attached to the hoop 18. According to the present invention, the coating 22 is a cured polymeric material which, as a result of cross-linking during curing, strongly adheres to the base film 20 as it hardens to provide considerable strength and durability for resisting the vigorous contact by sticks, brushes, and the like by the percussionist.

The coating 22 is preferably applied to a large sheet of base film 20 and cured before the filmic circles 14 are cut out for attachment to hoops 18. Many polymeric materials can cross link very quickly when exposed to actinic radiation, especially ultraviolet (UV) light, thereby completing the coating process much more quickly than drying by evaporation. With UV quick cure coatings, curing times can range from about 3 to 5 seconds (i.e., within about 5 seconds). However, the invention can be implemented by applying a variety of coatings that are sensitive to a variety of energy sources (i.e., UV to IR) to produce cross-linking of the polymeric material and thereby permanently adhere the material to the membrane 20 as a play surface.

Preferably, the coating is applied through by screen printing, for example, with a screen mesh of 175, but mesh screen sizes of 100 to 200 are suitable. The thickness of the cured coating can range from about 0.00135 to 0.00185 inch, with about 0.00165 inch being preferred. However, the screen can be non-uniform thereby resulting in a non-uniform coating such as shown in FIG. 1, in which the coating thickness T1 is relatively larger from the center 12 and decreases in a radially outward direction to a smaller thickness T2. The thickness can decrease gradually or can decrease stepwise. For example, thickness T1 can correspond to an inner circle whereas thickness T2 can correspond to an annular region. In another option, an inner circular portion of the base film 20 can be coated, whereas the outer annulus of the base film remains uncoated. Furthermore, the screen printing can produce a different color in one region than in another region.

The coating preferably includes dispersed solids, such as fine silicon dioxide or N-vinylcaprolactam, to provide a desired degree of roughness on the play surface. A surface roughness over 100 microinches is readily achieved, with a preference of at least 120 microinches, most preferably 135 to 200 microinches. Although a roughness of up to 120 microinches is present on some known drumheads, the rapid curing according to the present invention facilitates a homogeneous distribution of more highly loaded dispersed solids due to the rapid capture of the solids in the cross-linking matrix. Optionally, the base film 20 can be roughened before the coating 22 is applied.

The coating preferably comprises a UV curable ink, a UV colorant, and an adhesion promoter along with a suitable photoinitiator. One suitable UV curable ink comprises at least one acrylated oligomer, at least one acrylated monomer, at least one glycol ether acrylate, and a photoinitiator. Preferably, the UV curable colorant comprises titanium dioxide, a glycol ether acrylate, a vinyl functional monomer, an acrylated monomer, silicon dioxide, and a photoinitiator. The adhesion promoter can comprise a hexamethylene. Because both the ink and colorant are quickly actinically cured, the overall coating 22 is quickly cured.

The preferred coating composition (as applied) consists essentially of 100% (as base weight) NSC50 UV Air Texture Very Coarse Ink product, 30% (of base weight NSC50) 1878 High Intensity White UV Screen Ink, and 8% (of combined weight) NB80 UV Adhesion Promoter, all available from Nazdar Company, Shawnee Kans.

The invention claimed is:

1. A method for coating a drumhead membrane comprising:

applying a coating having cross linkable polymeric material to the membrane; and applying energy to cross link the polymeric material and thereby permanently adhere the material to the membrane as a play surface;

wherein the coating is applied to the membrane by screen printing and the coating comprises a UV curable ink, a UV curable colorant, and an adhesion promoter; and the energy is applied from a source of UV radiation.

2. The method of claim 1, wherein the UV curable ink comprises at least one acrylated oligomer, at least one acrylated monomer, at least one glycol ether acrylate, and a photoinitiator.

3. The method of claim 2, wherein the UV curable colorant comprises titanium dioxide, a glycol ether acrylate, a vinyl functional monomer, an acrylated monomer, silicon dioxide, and a photoinitiator.

4. The method of claim 3, wherein the adhesion promoter comprises a hexamethylene diisocyanate homopolymer.

5. The method of claim 1, wherein before coating the membrane, the membrane is roughened.

6. A method for coating a drumhead membrane comprising:

applying a coating having cross linkable polymeric material to the membrane; and applying energy to cross link the polymeric material and thereby permanently adhere the material to the membrane as a play surface;

wherein the membrane is a plastic film;

before coating the membrane, the membrane is roughened;

the coating is applied to the membrane by screen printing;

the coating comprises a UV curable ink; and the ink is cured with a source of UV energy.

7. The method of claim 6, wherein the screen is about 175 mesh.

8. The method of claim 1, wherein the coating includes dispersed solids that provide a play surface roughness of at least about 100 microinches.

9. The method of claim 8, wherein the solids provide a play surface roughness of at least 135 microinches.

10. A method for coating a drumhead membrane comprising:

applying a coating having cross linkable polymeric material to the membrane; and applying energy to cross link the polymeric material and thereby permanently adhere the material to the membrane as a play surface;

wherein the coating is applied through a print screen having a mesh size in the range of about 100-200 and cured with UV light within about 5 seconds to a thickness in the range of about 0.00135 to 0.00185 inch.

11. The method of claim 1, wherein the membrane is plastic and is roughened before the coating is applied.

12. The method of claim 8, wherein the solids provide a play surface roughness in the range of about 135 to 200 microinches.

13. A drumhead comprising a plastic membrane having a play surface comprising a coating of cross linked polymeric material, wherein the play surface has a roughness of at least about 120 microinches.

14. The drumhead of claim 13, wherein the coating has a thickness of at least about 0.00135 inch.

15. The drum head of claim 13, wherein the play surface is circular and the coating thickness varies along a radius of the play surface.

16. The drumhead of claim 14, wherein the play surface is circular and the coating thickness varies along a radius of the play surface.

17. A drumhead comprising a plastic membrane having a play surface comprising a coating of cross linked polymeric material, wherein the coating comprises the cross linked composition of at least one acrylated oligomer, at least one acrylated monomer, and at least one glycol ether acrylate.

18. The drumhead of claim 13, wherein the coating has a thickness in the range of 0.00135 to 0.00185 inch.

19. The drumhead of claim 13, wherein the plastic membrane is Mylar and the coating is a UV cured composition of at least one acrylated oligomer, at least one acrylated monomer, at least one glycol ether acrylate, having a thickness in the range of 0.00135 to 0.00185 inch and a roughness greater than about 135 microinches.

* * * * *